United States Patent [19]

Maruyama

[11] 4,254,884

[45] Mar. 10, 1981

[54] PLUG BODY FOR A CONTAINER

[75] Inventor: Takashi Maruyama, Urawa, Japan

[73] Assignee: Toppan Printing Co., Ltd., Japan

[21] Appl. No.: 84,560

[22] Filed: Oct. 15, 1979

[30] Foreign Application Priority Data

Oct. 20, 1978 [JP] Japan ..... 53-144204[U]
Sep. 21, 1979 [JP] Japan ..... 54-130943[U]

[51] Int. Cl.[3] ..... B65D 41/20
[52] U.S. Cl. ..... 215/232; 215/247
[58] Field of Search ..... 215/232, 247, 248, 249, 215/364; 150/8

[56] References Cited

U.S. PATENT DOCUMENTS

| | | | |
|---|---|---|---|
| 2,747,756 | 5/1956 | Hartop | 215/247 |
| 3,136,440 | 6/1964 | Krug | 215/247 |
| 3,198,368 | 8/1965 | Kirkland | 215/247 |
| 3,463,339 | 8/1969 | McGuckin | 215/247 |
| 3,934,746 | 1/1976 | Lilja | 215/247 X |
| 4,011,961 | 3/1977 | Widen | 215/232 |

*Primary Examiner*—Donald F. Norton
*Attorney, Agent, or Firm*—Lerner, David, Littenberg & Samuel

[57] ABSTRACT

A plug body for a plastic container for blood or the like wherein a rubber plug has upper and lower surfaces covered to be positioned by thermoplastic films, the surface of the thermoplastic film is partly exposed to serve as an inserting opening for an injection needle or the like, and an injection molded portion is surrounded with thermoplastic material of the same quality as the thermoplastic film.

14 Claims, 7 Drawing Figures

FIG.3
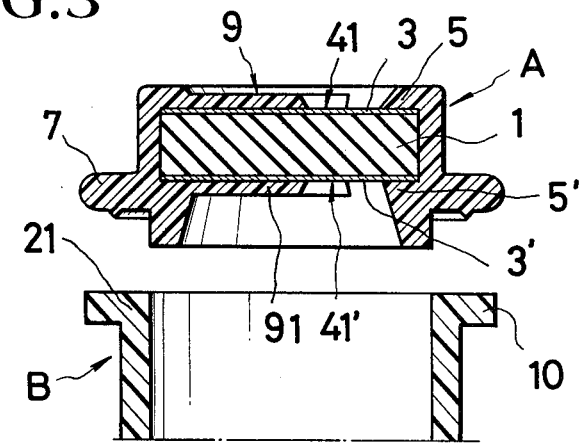
FIG.4
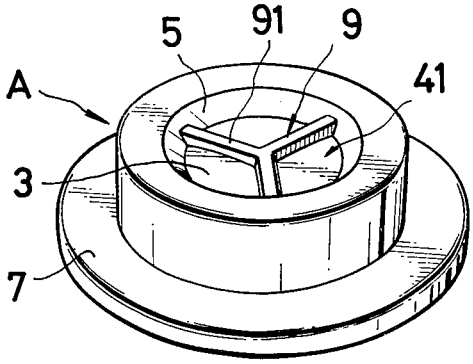
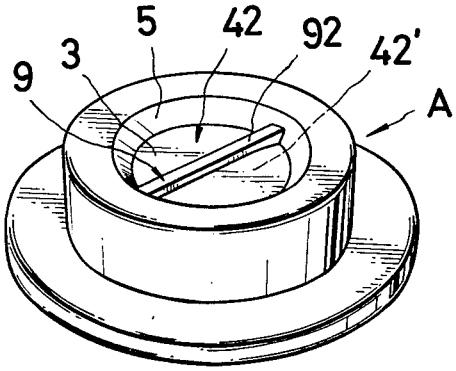
FIG.5

PLUG BODY FOR A CONTAINER

BACKGROUND OF THE INVENTION

The present invention relates to a plug body for a plastic container receiving liquids such as blood.

In the past, a container is filled with liquid such as blood, a lip portion of the container is then sealed by a plastic cap so that the container is sterilized, a rubber plug is fitted in or placed thereon, and a thermal shrinking overlap portion is further formed thereon. This construction is disadvantageous in that the rubber plug is not subjected to process of sterilization. That is, if sterilization is effected with the rubber plug attached to the container, cooling water enters between the plastic cap and the rubber plug during the sterilization process, which is bad for the health, and in addition, the rubber plug itself proceeds with deterioration under the influence of water at high temperature. Even if a fit is provided between the rubber plug and the plastic cap, there disadvantageously arises a liquid leakage from a boundary between the rubber plug and the plastic cap when a needle is inserted or removed.

SUMMARY OF THE INVENTION

This invention has been achieved in an effort to remove those disadvantages noted above with respect to conventional plug bodies for containers receiving blood or the like. It is an object of the invention to provide a plug body for a container which allows no entry of foreign matter, can be sterilized easily, can obtain firm fusion with the container, and can variously select a shape of a needle hole for injection syringes or the like.

That is, the present invention provides a plug body for a container wherein upper and lower surface thereof are covered to be positioned by thermoplastic films, and the other periphery of the rubber plug is surrounded with a thermoplastic resin of the same quality as said plastic film in a state where the surface of the thermoplastic film is partly exposed.

BRIEF DESCRIPTION OF THE DRAWINGS

FIG. 3 is a sectional view showing a plug body and a lip portion of a container in accordance with a further embodiment of the present invention;

FIG. 4 is a perspective view of the plug body of FIG. 3;

FIGS. 5 and 6 are perspective views of plug bodies in accordance with still other embodiments.

DETAILED DESCRIPTION OF THE INVENTION

Figure 1:
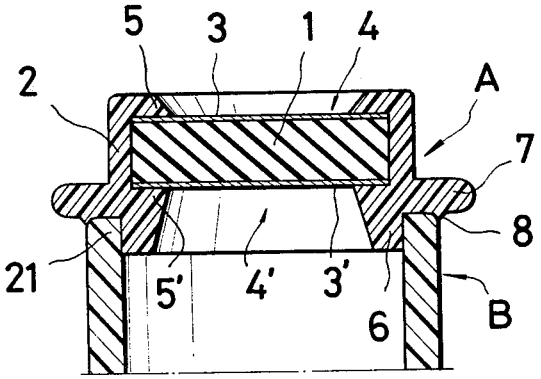
FIG. 1 is a sectional view showing one example in which a plug body for a container in accordance with the present invention fused to a lip portion of the container.

The present invention will be described by way of embodiment shown in the drawings.

As shown in FIG. 1, a plug body A for a container in accordance with the present invention is tightly fitted in a lip portion 21 of a plastic container B in which contents such as blood are received. The plug body A comprises a disc-like rubber plug 1 and an injection resin molded portion 2 surrounding thereof, said rubber plug 1 and molded portion 2 being fused in part through thermoplastic films 3, 3'. That is, upper and lower surfaces of the rubber plug 1 are covered with thermoplastic films 3, 3', and the injection resin molded portion 2 have a central portion in each surface thereof exposed while portions other than the central portion are surrounded and molded with injection resins. The exposed portion constitutes inserting openings 4, 4' for an injection needle or the like when in use. Reference numeral 5, 5' designate fused portions between the thermoplastic films 3, 3' and the injection resin molded portion 2. The additional construction of the injection resin molded portion 2 is that an annular body 6 is formed to be tightly fitted internally of the lip portion 21 of the container B, said annular body 6 being externally associated with a flange portion 7 which comes into close contact with an upper end in a peripheral edge of the lip portion 21 of the container B, said flange portion 7 having at its lower surface a rib 8 projected to fuse the flange portion 7 and lip portion 21 by means of a supersonic sealing process.

Next, a further embodiment of the present invention will be described in conjunction with FIGS. 3 and 4.

In this embodiment, upper and lower exposed inserting openings 41, 41' for an injection needle or the like are provided with a reinforcing portion 9. As shown in FIG. 4, three reinforcing members 91 radially extending from the center of the plug body A towards the outside are disposed towards the fused portion 5. When the plug body A is fused on the lip portion 21 of the container B by means of the supersonic sealing process, the exposed portion of the thermoplastic films 3, 3' i.e. the exposed portion of the inserting opening 41 for a needle or the like levitates from the surface of the rubber plug 1 and then is vibrated by a supersonic wave. The reinforcing portion 9 is therefore provided to prevent holes from being formed in such exposed portion by the vibrations. This is particularly effective when thinner thermoplastic films 3, 3' are used to form a plug body A.

Desirably, the shape of the reinforcing portion 9 will be one which passes through the center as in the radial reinforcing members 91 as shown in FIG. 4. For example, a single reinforcing member 92 extending the center may be applied to the fused portion 5 so as to form inserting openings 42, 42' obtained by dividing a circle into two sections as shown in FIG. 5.

Figure 6:
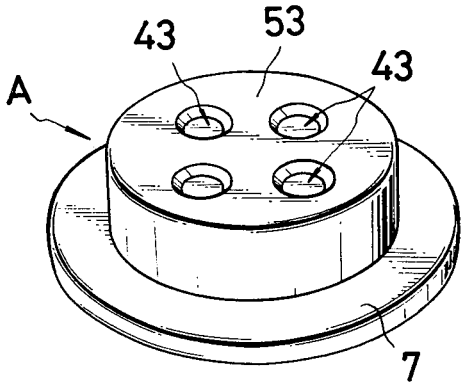

In an alternative embodiment shown in FIG. 6, upper and lower surfaces of a rubber plug covered with thermoplastic films have a wide fused portion 53, which is formed with a plurality of small-diameter inserting openings 43. The construction of this embodiment is advantageous to prevent the thermoplastic film from being torn under the influence of vibrations caused by supersonic waves when the plug body formed of a thinner thermoplastic film is fused on the lip portion of the container.

In FIG. 3, the reference numeral 10 designates a flange portion molded integral with the lip portion 21 of the container when the plastic container B is molded. By the provision of the flange portion 10, the plug body A may be fused on the lip portion 21 of the container easily and positively.

Figure 7:
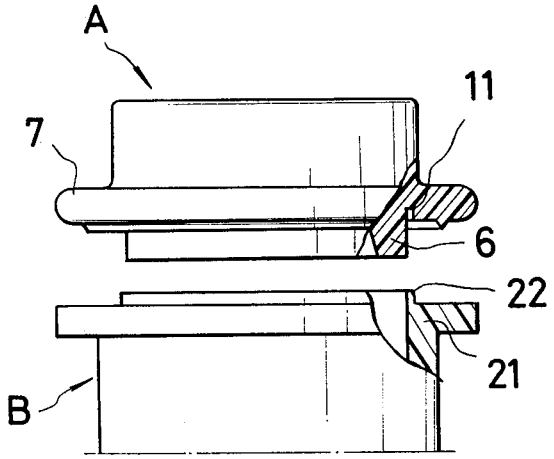
FIG. 7 is a partially cutaway front view showing a plug body and a lip portion of a container in accordance with another embodiment.

Further, in FIG. 7, the reference numeral 11 designates an annular recessed portion disposed in the vicinity of a boundary between the annular body 6 of the plug body A and the flange portion 7 of the plug body A. This annular recessed portion 11 is advantageous to prevent entry of melted plastic into the container when the recessed portion 11 slips on an annular convex portion 22 preformed in the lip portion 21 of the container to fuse the plug body A and container B together.

Figure 2:
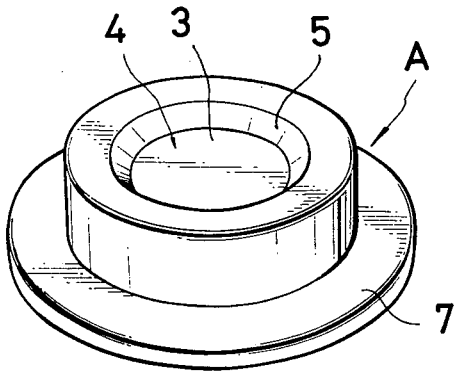
FIG. 2 is a perspective view of the plug body of FIG. 1.

In the manufacture of a plug body in accordance with the present invention, a conventional injection molding machine may be used. Preferably, a vertical injection molding machine is used due to the fact that the rubber plug with upper and lower surfaces thereof covered with thermoplastic films is inserted into a mold. The mold is such that the inserting opening is held by upper and lower cores with the plastic films 3, 3' positioned above and below about the plug 1, and a vacant cavity of the mold is filled with injection resin. Here, the height of the cavity between the upper and lower cores is made lower by 0.1–0.2 mm than the thickness of the rubber plug 1 and the plastic films 3, 3', and the rubber plug 1 and films 3, 3' are firmly pressed by fastening. That is, the mold may be of either pin gate type or side gate type. Where one gate opening is employed, an insert must be prevented from deviation from the center under the influence of injection pressure, and air must be prevented from its remaining between the rubber plug 1 and films 3, 3'. As for one example, the process is accomplished under the conditions that the rubber plug 1 is formed of chlorinated butyl rubber, 3 mm; thermoplastic films 3, 3', conventional polypropylene, 0.2 mm thick, 2 sheets; injection resin, polypropylene; injection molding machine, general vertical injection molding machine; mold, side gate type, single; resin temperature, 260° C.; injection pressure, 50 kg/cm$^2$; injection time, 8 sec.; and cooling time, 20 sec. The thus formed article is that as shown in FIGS. 1 to 3, the rubber plug 1 has the plastic films 3, 3' placed above and below thereof and is surrounded and formed by injection resins of the same quality as said films, and accordingly, it is extremely hygienic because water due to hot water or steam and dust do not enter at the time of sterilization.

Optimum material for the injection resins and thermoplastic films is polypropylene. The rubber plug has thickness from 2 to 6 mm in view of the inserting force of the injection needle or the like and prevention of liquid leakage, and the plastic film suitably has a thickness from 0.1 to 0.4 mm. Further, since the fused portions 5, 5' between the rubber plug 1 and plastic films 3, 3' are pressed by injection pressure, there is no leakage of liquid from the periphery of the rubber plug. Moreover, if the reinforcing portion 9 is formed within the inserting opening, the thermoplastic films 3, 3' are never destroyed by vibrations resulting from supersonic sealing of the plug body to the container lip.

As described above, one feature of the present invention is that the plug body has its upper and lower surfaces covered by thermoplastic films, and the outer periphery of the rubber plug is surrounded with a thermoplastic resin of the same quality as said plastic film in a state where the surface of the thermoplastic film is partly exposed. With this arrangement, therefore, the rubber plug is never disengaged. Further, no foreign matter enters, sterilization may be accomplished easily, the plug has good strength, the plug is fused on the container so that parts may be minimized, and an overcap is not required. In addition, the device can to be molded into a small type, and the needle receiving opening may be variously selected in size and shape so that the needle may be inserted easily. Furthermore, in the plug body of the present invention, the rubber plug is pressed from the outer periphery thereof so that the inserted needle is peripherally pressure-sealed by the rubber plug closely. For this reason, there is no risk in leakage of liquid even during use. As mentioned above, the present invention offers various advantages.

Moreover, the inserting opening for the injection needle or the like, that is, the portion to which the thermoplastic film is exposed is provided with a reinforcing portion whereby when the plug body of the present invention is fused on the lip portion of the container by means of the supersonic sealing process, it is possible to prevent the plastic film from being vibrated resulting from disengagement thereof from the rubber plug. This is particularly effective if the plastic film is thinner.

What is claimed is:

1. A plug body for a plastic container receiving therein liquids such as blood, in which a rubber plug whose upper and lower surfaces are covered with thermoplastic films is positioned in the center of the plug body, and the rubber plug is outer peripherally provided with an injection molded portion with thermoplastic resin of the same quality as said plastic films said portion having inserting openings exposing the surfaces of said films.

2. The plug body according to claim 1 wherein the injection molded portion has a flange portion adapted to be fused on a lip portion of the container.

3. The plug body according to claim 1 wherein the injection molded portion includes an annular body adapted to be fitted internally of a lip portion of the container.

4. The plug body according to claim 1 wherein the injection molded portion includes a flange portion adapted to be fused on a lip portion of the container and an annular body adapted to be fitted internally of said lip portion of the container.

5. The plug body according to claim 4 including a recessed portion disposed in a boundary between the annular body and the flange portion.

6. The plug body accoding to claim 1 wherein at least one of said inserting openings is divided by a reinforcing portion.

7. The plug body according to claim 6 wherein the reinforcing portion comprises a plurality of radial reinforcing members.

8. A plug body for a container comprising a rubber plug having an upper surface, a lower surface, and an outer periphery therebetween, a thermoplastic film covering said upper and lower surfaces of said rubber plug, and an injection molded member in contact with said outer periphery of said rubber plug, said injection molded member comprising a thermoplastic resin, whereby at least a portion of said thermoplastic film covering said upper and lower surfaces of said rubber plug are exposed so as to provide inserting openings for said plug body.

9. The plug body of claim 8 wherein said container includes a lip portion, said injection molded member including a flange portion adapted to be fused on said lip portion of said container.

10. The plug body of claim 9 wherein said injection molded member includes a depending annular body adapted to be fitted internally of said lip portion of said container.

11. The plug body of claim 8 wherein said plug body includes a reinforcing portion covering a portion of at least one of said inserting openings.

12. The plug body of claim 11 wherein said reinforcing portion comprises a plurality of radial reinforcing members.

13. The plug body of claim 8 wherein said container includes an annular projecting portion, said plug body including an annular recessed portion for cooperation with said annular projecting portion of said container.

14. The plug body of claim 8 wherein said injection molded member covers said thermoplastic film covering upper surface of said rubber plug and includes a plurality of openings therein.

* * * * *